United States Patent [19]

Bisbing

[11] Patent Number: 4,655,489

[45] Date of Patent: Apr. 7, 1987

[54] FASTENING DEVICE

[75] Inventor: Robert H. Bisbing, Springfield, Pa.

[73] Assignee: Southco, Inc., Concordville, Pa.

[21] Appl. No.: 723,847

[22] Filed: Apr. 16, 1985

[51] Int. Cl.[4] ..... E05C 19/02

[52] U.S. Cl. ..... 292/110; 292/DIG. 4; 292/DIG. 38; 292/DIG. 49; 292/337

[58] Field of Search ..... 292/110, 128, 333, 337, 292/DIG. 4, DIG. 49, 251.5, DIG. 38

[56] References Cited

U.S. PATENT DOCUMENTS

| | | | |
|---|---|---|---|
| 1,755,392 | 4/1930 | Hagstrom et al. | 292/DIG. 4 X |
| 1,934,105 | 11/1933 | Totty | 292/333 |
| 2,294,683 | 9/1942 | Murphy | 292/DIG. 4 X |
| 2,517,059 | 8/1950 | Van Every | 292/DIG. 4 X |
| 2,637,576 | 5/1953 | Nottingham | 292/DIG. 4 X |
| 2,789,852 | 4/1957 | Eads | 292/110 |
| 3,425,729 | 2/1969 | Bisbing | 292/251.5 |

*Primary Examiner*—Richard E. Moore
*Attorney, Agent, or Firm*—Paul & Paul

[57] ABSTRACT

A two-piece fastening assembly, for cabinet doors and other relatively movable objects, is disclosed. One piece comprises a housing, having attachments on its outside to fix it to one of the movable objects, with a rotatable, reciprocating catch positioned inside having projections which alternately engage fixed sockets in the housing. The other piece is a keeper that is attached to the other movable object that contacts the reciprocating catch and allows closing and opening of the two parts.

5 Claims, 9 Drawing Figures

FASTENING DEVICE

BACKGROUND OF THE INVENTION

Fastening devices have long been helpful in the cabinet-making industry by providing a positive latching mechanism that is efficient, simple to operate and economical to produce. The fastening device on a wall cabinet, or a closet, provides integrity to the structure by keeping the door closed and latched.

As business and home life becomes more and more hectic, there are many instances when a simple latching mechanism, one that takes a free hand to unlatch, becomes more of a nuisance than a help. As these problems continued, the push release fastening device gained in popularity, and is now in wide use.

U.S. Pat. No. 2,637,576 to R. K. Nottingham is one example of a push release device. That patent shows a plunger in the form of a flat bar and a latch having a bight portion, used to capture an inserted keeper head. While push release devices of the type shown in the Nottingham patent have been used heretofore in the form of relatively large push release devices, there are a number of inherent problems in such structures which make them inappropriate for constructing relatively small devices as, for instance, a device which may be 1½ inches long by ¾ inches wide and about ⅜ inches deep. The problem of constructing such a relatively small device in the form shown in the Nottingham patent arises from the fact that the structure and operation of such devices involves movable sockets which engage fixed pins. In a relatively large device it is possible to provide not only a rigid movable piece in which such sockets are formed, but also to provide sufficient force in the form of multiple springs to carry out the motion of such movable piece and such integral sockets. However, as the size of such a push release device gets smaller and smaller a point is reached where the construction of a movable socket device becomes impractical and its operation becomes less and less reliable. I have discovered that the problems associated with movable socket push release devices can be overcome by forming sockets which are immovable, which are integral with the housing of the device and providing projections which are integral with a movable catch member. These projections are moved into and out of such fixed sockets as the catch member is rotated and one of such projections is provided with a cam surface for engagement with a separately movable element which forces such projection into firm engagement with the uppermost fixed socket. Since such fixed sockets are immovable, the catch member projections are snapped positively and firmly into engagement with the respective sockets. This action is described hereinafter in more detail.

SUMMARY OF THE INVENTION

The instant invention provides a mechanism that allows a first push to close a door and to secure it and a second push to open it. The mechanism has a pivotable and reciprocating catch springloaded to a slidable plunger inside a specially constructed housing having fixed integral sockets. The catch is provided with projections which engage the fixed sockets when the catch is rotated to either the clockwise or counterclockwise limits of its rotation. When a keeper attached to a door is inserted into the housing, it displaces the plunger laterally and permits a spring force to rotate the catch downward to engage a projection on the keeper. A second push activates a stored-up spring force which forces the catch away from the keeper and moves the keeper out of engagement with the catch, thus providing a lateral motion of the keeper to a position free of the device.

OBJECTS OF THE INVENTION

It is therefore an object of the present invention to produce a simple and effective push release fastening device.

It is a further object of the invention to produce a simple and efficient push release fastener that may be easily installed in a cabinet, closet or other similar fixture.

It is a still further object of the invention to produce a push release fastener that has reliable and positively working movable parts and is more compact than existing units.

It is a still further object of the present invention to provide a push release fastener having fixed, immovable sockets for receiving projections formed on a movable member when it is rotated.

These and other objects and advantages of the present invention will be readily apparent to those skilled in the art by reading the following brief description of the drawings, a description of the preferred embodiment and the appended claims.

DESCRIPTION OF THE PREFERRED EMBODIMENT

The fastening device of the present invention is used to fasten and unfasten a door, or other relatively movable object, relative to the frame of a cabinet or closet. The device has three movable parts, a catch 50, a slidable plunger 70 and a keeper 12. In the remaining paragraphs, the terms "up" and "down" will refer to the top and bottom, respectively, of the pages of drawings, and the terms "front" and "rear" will refer to the right side and left side, respectively, of the pages of drawings.

Figure 1:
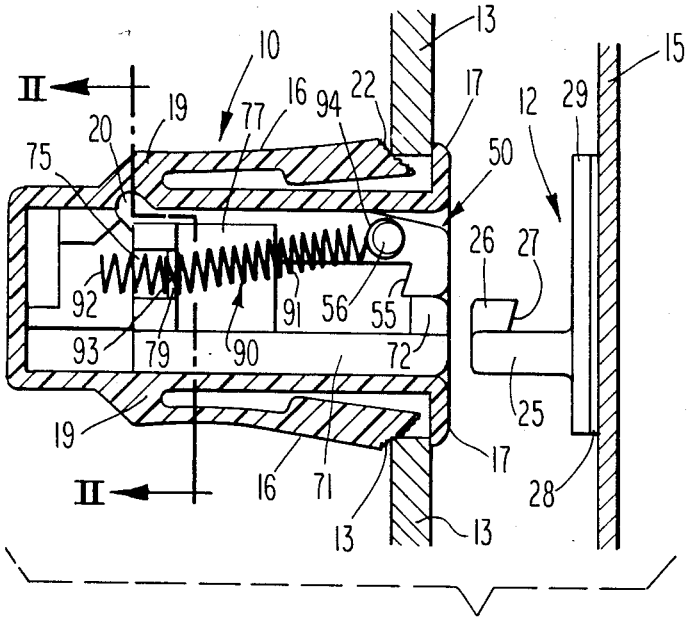
FIG. 1 shows a cross-sectional view of the fastening device installed on a cabinet door and cabinet (both in partial)

As shown in FIG. 1, housing 10 is inserted into a predrilled hole or cavity in the proper location in the frame of a cabinet or closet, as shown in partial by walls 13. Keeper 12 is attached to a door 15, or other relatively movable object, at the proper location by means known in the industry. Housing 10 has spring pawls 16 affixed from a top surface and a bottom surface, and a flange 17 constructed to engage the front opening 18 when the housing is inserted into the hole. Pawls 16 are attached to housing 10 as at 19. Pawls 16, at the front thereof, have a plurality of beveled surfaces 22 with serrations 22 therein to forcibly hold housing 10 inside the cavity, against the edges thereof, in the frame of the cabinet. Housing 10 also has an indentation forming a fixed socket 20 in the inside of the roof housing of 10 and a second fixed socket 31 formed in block 32 which is attached to a side wall of housing 10 at a level substantially below that of socket 20. Alternatively, block 32 and its associated socket 31 may be molded as an integral part of housing 10.

Keeper 12 has a base 29 and a stub 25 perpendicularly projecting therefrom. Stub 25 carries a hook 26 on its upper surface, which hook 26 has a slanting vertical surface 27, making an angle of approximately 30° with stub 25, for a purpose to be described later. Base 29 can be affixed to cabinet door 15 by an adhesive substance, as at 28, or any of the other commonly known techniques.

The inner dimensions, including length, width and height, of housing 10 are precalculated to allow the internal components to rotate or pivot or slide therein and maintain the proper spacing, amongst all parts, as will be shown, and therefore allow the parts to function reliably and consistently. Housing 10 has interior side walls, a ceiling and an end wall.

Figure 3:
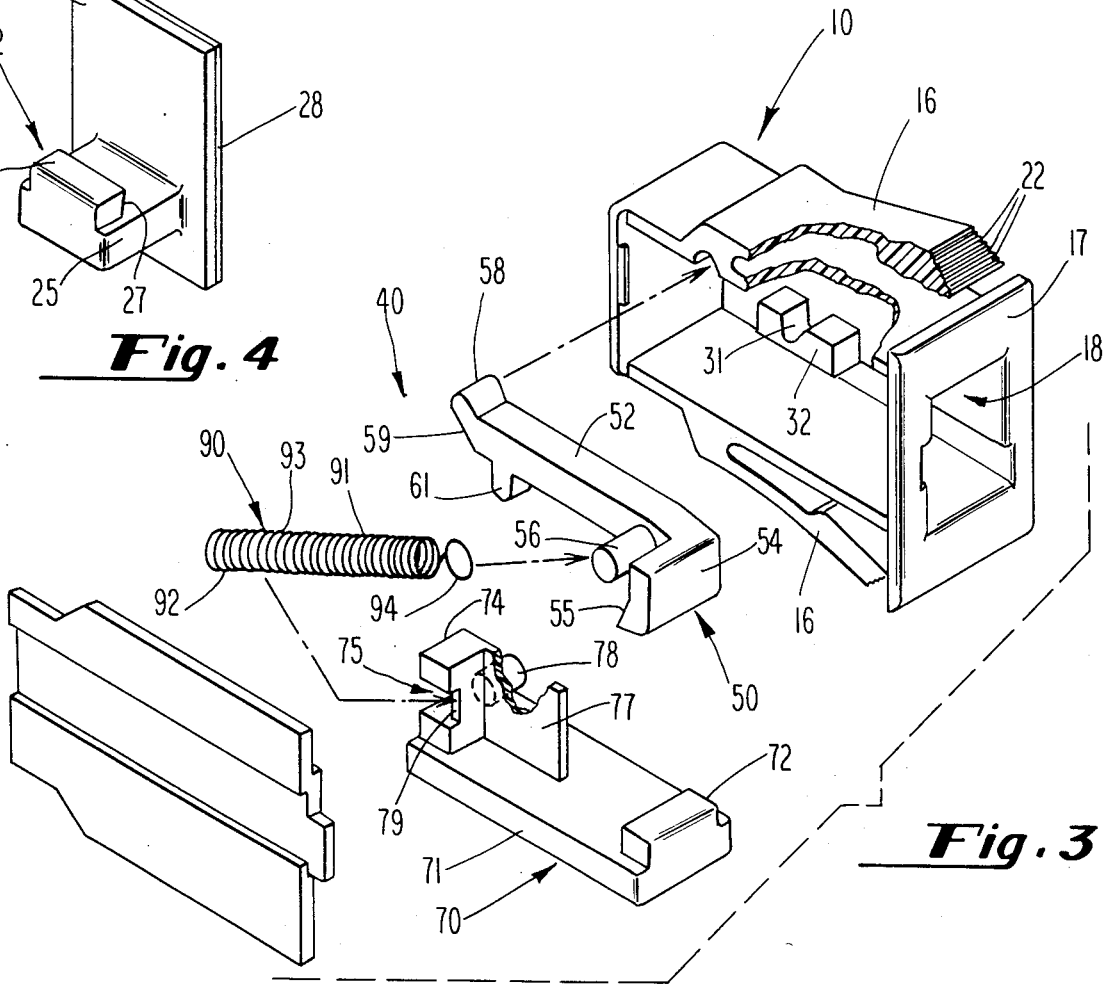
FIG. 3 shows a perspective view of the housing and plunger with the individual components expanded.
Figure 5A:
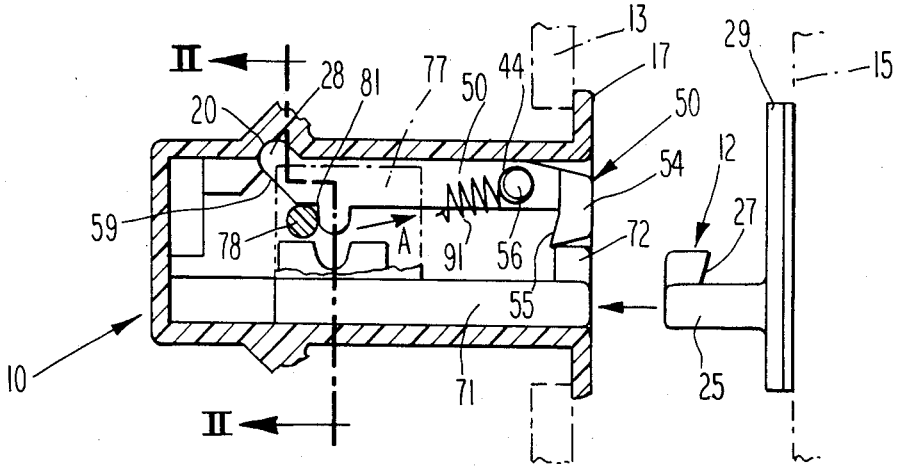
FIGS. 5(*a*)–5(*e*) show the latching and unlatching sequences by showing the housing and keeper in cross-sectional view similar to FIG. 1.
Figure 5B:
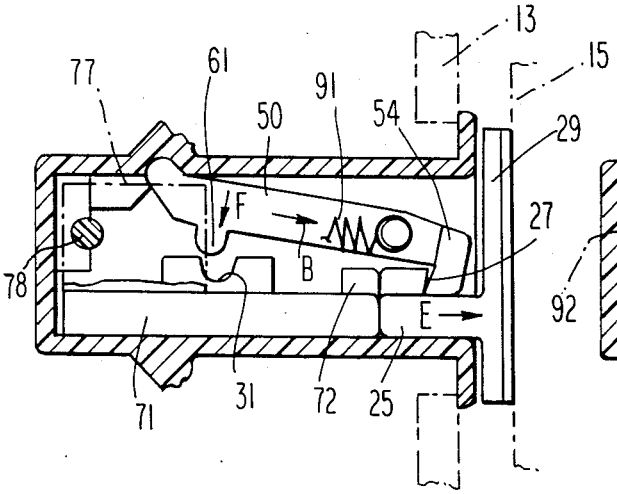
Figure 5C:
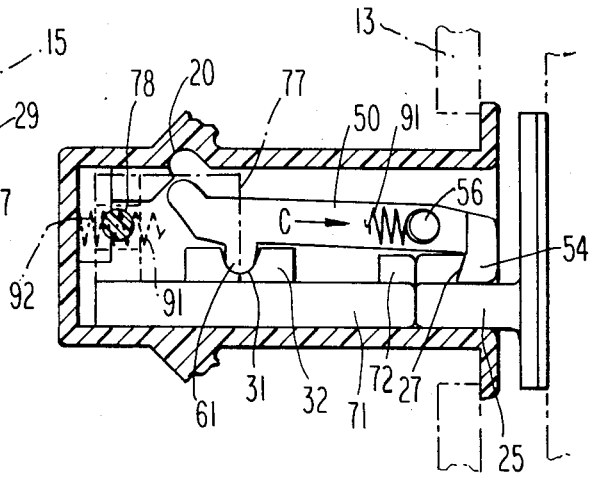
Figure 5D:
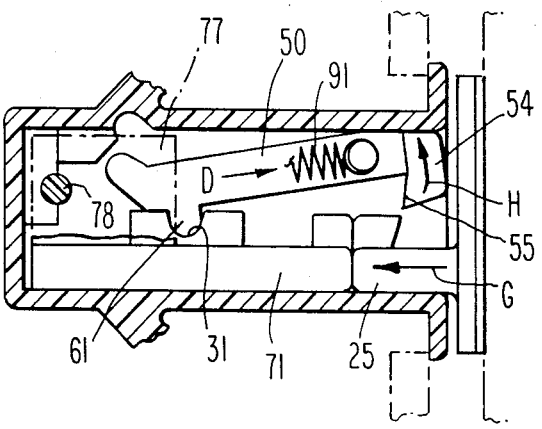
Figure 5E:
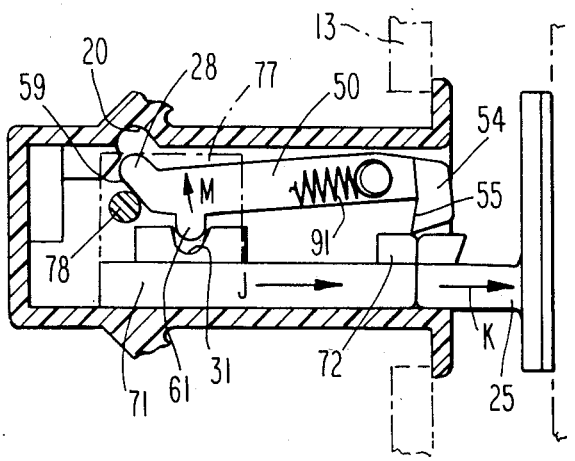

FIG. 3 shows a perspective view, with the parts expanded, of the housing 10, an upper rotatable part or catch 50, a lower part or plunger 70, and a compression-/extension spring 90 connecting the two. Plunger 70 has a base 71 of a precalculated length, width, and thickness. At the front end thereof is a stub 72 of substantially the same width as the width of base 71 and of a precalculated height for a purpose to be described later. At the back end thereof is a vertically projecting block 74 of precalculated height and thickness of approximately one-half the total width of base 71. Block 74 is located at the left rear of base 71 for a purpose to be described later. Block 74 has a cavity 75, at a precalculated location, extending from the back end forward so as to leave a relatively thin, spring-restraining wall 79. Plunger 70 further has a center board 77 orthogonally projecting from the center of base 71 and block 74. Block 74 carries a projection 78 at a precalculated location on the right side thereof for a purpose to be described later.

Figure 2:
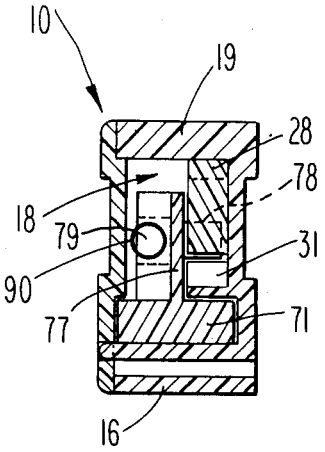
FIG. 2 shows a cross-sectional view taken along lines II—II of FIG. 1.
Figure 4:
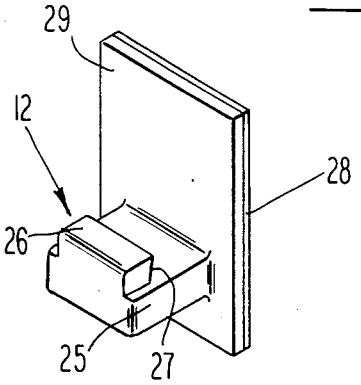
FIG. 4 shows a perspective view of the keeper.

A catch 50 is located adjacent to plunger 70 as shown in FIGS. 1 and 2. Catch 50 is relatively movable by projection 78 and a combination compression/extension spring 90 as will be described later. Catch 50 has a relatively thin, longitudinal piece 52 of a precalculated width and length. Piece 52, at the front end thereof, extends downwardly and forms into a hook 54 which is substantially as wide as opening 18. Hook 54 is of a precalculated length and thickness, and on its inner, slanted surface 55 allows for the contacting and releasingly holding of surface 27 on keeper 12. Surface 55 is formed at an angle of approximately 30° from a verticle projection (not shown) through the inner corner of hook 54. A first projection 56 from the side of piece 52 is adjacent end 54 and allows a tension part 91 of spring 90 to be attached thereto to extend said spring and store energy. This is done at assembly of the unit. As earlier mentioned, spring 90 is a combination compression/extension spring. The total length of spring 90 is precalculated and approximately one-half of that length is devoted to the tension part of the spring, shown as 91. The latter half of the spring 90 is formed as a compression spring 92. The junction 93 between the tension part 91 and the compression part 92 neatly fits over thin wall 79 of plunger 70, to anchor part 92 of the spring and position it in cavity 75 to be ready to store energy when the plunger 70 moves to the rear.

At the rear end of catch 50 is a nob 58 projecting from the upper rear corner thereof. Immediately adjacent nob 58 on the lower edge of the back end of catch 50 is a beveled cam surface 59, of a precalculated angle. Extending from the bottom surface of catch 50 is a second projection 61. Projections 58 and 61 are positioned so that they move into positive engagement with sockets 20 and 31 when catch 50 is rotated from one extreme position to the other.

OPERATION

Referring to FIGS. 5(*a*) through 5(*e*), the operation of the fastening device of the present invention and the interaction of the fixed and moving parts are shown. In each of FIGS. 5(*a*) through 5(*e*), center board 77 is shown in ghost outline to allow observation of the interaction of parts behind that piece. In addition, to aid in explaining how the parts interact, spring 90 has only been partially shown. The compression end 92 of spring 90, although not shown in FIGS. 5(*a*) through 5(*e*), is compressed against the inside of the back end of housing 10 as plunger 70 is pushed in that direction by keeper 12 as will be described later.

One novel and key action of the fastening device is the changes in the line of direction of spring 90, as shown by arrows A, B, C and D in FIGS. 5(*a*), 5(*b*), 5(*c*) and 5(*d*), respectively. FIG. 5(*a*) and FIG. 1 show the components of the fastening device in the unlatched position. The tension section 91 of spring 90 is stretched between wall 79 and first projection 56. The compression end 92 of spring 90 rests partially in cavity 75 and partially projects outside of cavity 75. The location of cavity 75 and thin wall 79 have been precalculated to anchor junction 93 at a lower level, initially than where hook 94 (as seen in FIG. 3) anchors the opposite end of the tension section 91 to first projection 56. Spring 90 is physically forced into this position when the fastening device is assembled and this force is stored as potential energy which will cause tension section 91 to return to as horizontal a position, relative to junction 93, as it can during the movement of the components. As shown in FIG. 5(*a*), stub 72 on plunger 70 blocks any downward movement of hook 54 and thereby prevents tension section 91 from being restored to its natural (i.e., unextended) position. This movement of section 91, together with the uncoiling of compression section 92 as plunger 70 slides towards the front of housing 10, is responsible for the reciprocating nature of catch 50.

The second novel and key action of the instant invention is the shifting of the pivot points of catch 50. As seen in FIG. 5(*a*), knob 28 is firmly seated in socket 20. As shown in FIG. 5(*b*), hook 54 ultimately rotates clockwise about knob 28 and compression end 92 of spring 90 starts to exert pressure on plunger 70, which pressure is transferred by stub 25, as shown by Arrow E, to rightwardly directed force on the tip of hook 54. This force unseats projection 28 from socket 20, and, due to the tension from spring 90 (as explained above), forces second projection 61 to be rotatingly seated in a second socket 31 in side block 32, as shown by Arrow F. Block 32 is molded to or affixed at a precalculated location on the inner surface of the right side wall of housing 10 (see FIG. 5(*c*)).

Catch 50, when a second push (as shown by Arrow G) is applied to stub 25 and thence to plunger 70, rotates counterclockwise (as shown by Arrow H) and projection 61 rotates inside fixed socket 31 (see FIG. 5(*d*). Further lateral movement of base 71 and stub 25 (as shown by Arrows J and K, respectively) bring projection 78 into contact with cam surface 59. Projection 78 is forced against the inclined surface 59. At the same time tension end 91 of spring 90 pulls against projection 61 (as shown by Arrow M in FIG. 5(*e*)), and catch 50 is reset into its initial position with knob 22 firmly seated in socket 20.

The above-described pivoting action and resetting action is unique and advantageous over the prior art. Catch 50 is a free-floating object, within the confines of housing 10, that pivots about three points and is moved by forces from three sources. As seen in FIG. 5(*a*), knob 28 is seated, for rotating movement, in fixed socket 20. Projection 78 on base 71 is ultimately forced up against a corner 81 between surface 59 and projection 61 on catch 50 and, in cooperation with the contact between base stub 72 and hook 54, prevents catch 50 from responding to the pressure exerted by tension part 91.

The initial push, when keeper 12 is inserted into housing 10, sends base 71 to the rear of housing 10 (as seen in FIG. 5(*b*)) and removes both base projection 78 and base stub 72 from preventing motion of hook 54. The stored energy in tension part 91 reacts on projection 56, and because the line of the spring force is below the pivot point (knob 28 in socket 20), hook 54 moves clockwise and surface 55 (on hook 54) is engaged by surface 27 on the now returning keeper 12.

The force on catch 50 is now transferred to the second pivot point, the contact between surface 27 and surface 55, and, since this point is below the spring force (as shown in FIG. 5(*b*)), projection 61 slips down into indentation 31 in side block 32. This movement of catch 50 has shifted it into the third pivot point, i.e. projection 61 inside indentation 31 (as seen in FIG. 5(*c*)).

The second push serves to back base 71, and therefore surface 27, away from hook 54, and now, since catch 50 can only pivot about projection 61, hook 54 rotates counterclockwise to the inner ceiling of housing 10. The expanding section 92 combined with the contracting part 91 brings projection 78 up against surface 59 and forces the re-set of knob 28 into fixed socket 20. The cycle of movements is now completed and the fastening device is ready to latch and unlatch again. This changing of the pivot points of catch 50 relative to fixed sockets has the advantage of allowing a fastening device that is both smaller than prior art devices and more positive in its toggling and resetting functions.

Obviously, many modifications and variations of the present invention are possible in light of the above teachings, and, it is therefore understood that within the scope of the disclosed inventive concepts, the invention may be practiced otherwise than as specifically disclosed.

What is claimed is:

1. A fastening device for releasably securing two relatively movable members together, comprising:

(a) a housing having an opening in the front thereof, a cavity therein, a first fixed socket in the inside of the upper surface thereof, a second fixed socket at a predetermined location forward and below said first socket, and attachment means for affixing said housing to one of said members;

(b) a keeper means for attachment to said other member and having a hooked projection positioned to be inserted within said housing upon relative movement of said members towards one another;

(c) a plunger means positioned within said housing for lateral movement therein in response to the insertion or withdrawal of said keeper means;

(d) a catch member positioned within said housing for reciprocal movement between said first and second fixed sockets and for pivotal movement within said sockets in response to said lateral movement of said plumger means, and having a hook at one end thereof for releasably engaging said inserted keeper means to secure said members together; and (e) a spring having an extension portion disposed between said catch means and said plunger means and a compression portion disposed between said plunger means and said housing, wherein upon lateral movement of said plunger means the line of direction of said spring is re-directed to impart reciprocal and pivotal movement of said catch means to engage or disengage said inserted keeper means.

2. The fastening device of claim 1, wherein said catch means is disposed within said first fixed socket when in an unlatched condition.

3. The fastening device of claim 2, wherein said catch means is disposed within said second fixed socket when in a latched condition.

4. The fastening device of claim 1, wherein said plunger means includes a projection extending therefrom for contacting said catch means and moving same into said first fixed socket upon lateral movement of said plunger into an unlatched condition.

5. The fastening device of claim 1, wherein said attachment means comprises a pair of spring-pawls, each of which is connected at one end to the exterior of said housing and having a plurality of beveled surfaces at the other end thereof for contacting said member.

* * * * *